US010480742B2

(12) United States Patent
Joerg et al.

(10) Patent No.: US 10,480,742 B2
(45) Date of Patent: Nov. 19, 2019

(54) OPTICAL MODULE FOR A MOTOR VEHICLE

(71) Applicant: VALEO VISION, Bobigny (FR)

(72) Inventors: Alexandre Joerg, Bobigny (FR); Marine Courcier, Unterfoehring (DE)

(73) Assignee: VALEO VISION, Bobigny (FR)

( * ) Notice: Subject to any disclaimer, the term of this patent is extended or adjusted under 35 U.S.C. 154(b) by 0 days.

(21) Appl. No.: 15/720,034

(22) Filed: Sep. 29, 2017

(65) Prior Publication Data

US 2018/0087736 A1 Mar. 29, 2018

(30) Foreign Application Priority Data

Sep. 29, 2016 (FR) ..... 16 59371

(51) Int. Cl.

| | |
|---|---|
| ***F21S 41/153*** | (2018.01) |
| ***F21S 41/26*** | (2018.01) |
| ***F21S 41/24*** | (2018.01) |
| ***F21S 41/143*** | (2018.01) |
| ***F21S 41/25*** | (2018.01) |
| ***F21S 41/19*** | (2018.01) |
| ***F21S 41/29*** | (2018.01) |
| ***F21S 45/47*** | (2018.01) |

(Continued)

(52) U.S. Cl.

CPC ..... *F21S 41/26* (2018.01); *F21S 41/143* (2018.01); *F21S 41/153* (2018.01); *F21S 41/19* (2018.01); *F21S 41/24* (2018.01); *F21S 41/25* (2018.01); *F21S 41/29* (2018.01); *F21S 45/47* (2018.01); *F21Y 2105/16* (2016.08); *F21Y 2115/10* (2016.08)

(58) Field of Classification Search

CPC ..... F21S 41/26; F21S 41/24; F21S 41/143; F21S 41/295; F21S 41/25; F21Y 2115/10; F21Y 2105/16

See application file for complete search history.

(56) References Cited

U.S. PATENT DOCUMENTS

| | | | | |
|---|---|---|---|---|
| 2015/0131305 A1* | 5/2015 | Courcier | ..... | F21S 48/1225 362/516 |
| 2016/0018075 A1* | 1/2016 | Ohno | ..... | F21S 48/1721 362/511 |

(Continued)

FOREIGN PATENT DOCUMENTS

| | | |
|---|---|---|
| EP | 2 587 125 A2 | 5/2013 |
| EP | 2 743 567 A1 | 6/2014 |

(Continued)

OTHER PUBLICATIONS

French Preliminary Search Report dated Feb. 24, 2017 in French Application 16 59371 filed on Sep. 29, 2016 (with English Translation of Categories of Cited Documents).

*Primary Examiner* — Donald L Raleigh

(74) *Attorney, Agent, or Firm* — Oblon, McClelland, Maier & Neustadt, L.L.P.

(57) ABSTRACT

An optical module for a motor vehicle, the module having a longitudinal optical axis including a matrix array of elementary light sources emitting from a common emission plane that is orthogonal to the optical axis, and a projecting lens for projecting the image of the elementary light sources. The projecting lens includes an object focal surface having a curvature defect. A field-correcting optical element is interposed between the emission plane and the projecting lens.

20 Claims, 2 Drawing Sheets

(51) Int. Cl.
*F21Y 105/16* (2016.01)
*F21Y 115/10* (2016.01)

(56) References Cited

U.S. PATENT DOCUMENTS

| | | | | |
|---|---|---|---|---|
| 2016/0341386 | A1 | 11/2016 | Iha et al. | |
| 2016/0347236 | A1* | 12/2016 | Yatsuda | B60Q 1/085 |
| 2016/0368414 | A1* | 12/2016 | Son | F21S 41/663 |

FOREIGN PATENT DOCUMENTS

| | | | |
|---|---|---|---|
| EP | 2 871 406 | A1 | 5/2015 |
| EP | 2 975 318 | A1 | 1/2016 |
| WO | WO 2015/107678 | A1 | 7/2015 |

* cited by examiner

OPTICAL MODULE FOR A MOTOR VEHICLE

TECHNICAL FIELD OF THE INVENTION

The invention relates to a motor-vehicle optical module that is able to produce a segmented light beam.

TECHNICAL BACKGROUND OF THE INVENTION

Optical modules of this type are already known. They are able to emit forward longitudinally a final light beam that is referred to as a "multibeam" or even a "pixel beam". The final light beam projects forward an image of a matrix array of elementary light sources. By selectively turning-on or turning-off each of the elementary sources, it is possible to create a final light beam that specifically illuminates certain zones of the road in front of the vehicle, while leaving other zones in darkness.

Such an optical module is in particular used in front lighting devices to produce an adaptive lighting function also referred to as an adaptive driving beam or ADB. Such an ADB function is intended to automatically detect a road user liable to be dazzled by a lighting beam emitted in high-beam mode by a headlamp, and to modify the outline of this lighting beam so as to create a zone of shadow in the location of the detected user while continuing to light the road to great distance on either side of the user. The advantages of the ADB function are multiple: user comfort, better visibility with respect to lighting in low-beam mode, greatly decreased risk of dazzle, safer driving, etc.

Such a module generally includes a matrix array of primary light sources, generally formed by light-emitting diodes (LEDs), a first primary optical element including a plurality of light guides and a projecting lens. The light-emitting diodes are arranged on a flat printed circuit board that lies in a plane orthogonal to the direction of projection of the final light beam. The light guides of the primary optical element extend, on the whole, longitudinally from an entrance face for the light to an exit face for the light. The light guides are intended to form the rays emitted by the light-emitting diodes into narrower pencil light beams having the shape of a pixel, which is generally rectangular or square. The exit faces of the light guides form the matrix array of secondary elementary light sources imaged by the projecting lens.

Such a module requires the projected image of the secondary elementary light sources to have a controlled sharpness and light distribution so that the final light beam formed by the combined images of the secondary elementary light sources has a uniform light distribution. This makes it possible to guarantee that the driver of the vehicle will not be annoyed by variations in lighting level due to dispersions in light intensity, for example in zones in which a plurality of secondary elementary sources superpose.

Such an optical module is however liable to be subject to optical aberrations such as spherical aberration, coma, distortion, astigmatism, Petzval field curvature, etc.

The present invention more particularly relates to the solution of problems due to Petzval field curvature. Theoretically, the projecting lens is supposed to have an object focal surface formed by a plane orthogonal to the optical axis of said lens. However, this object focal surface in fact has a concave spherical curvature.

Thus, if the secondary elementary light sources of the matrix array, in our case the exit faces of the light guides, are arranged in a plane orthogonal to the optical axis of the projecting lens, only the secondary elementary light sources that are located on the curved object focal surface will be projected clearly. The projection of the other secondary elementary light sources, which will be located in front or behind the curved object focal surface, will be relatively blurry depending on their longitudinal distance with respect to the object focal surface.

To solve this problem, it has already been proposed to modify the structure of the primary optical element in order to arrange the exit faces of the light guides on a curved surface closely following the curvature of the real object focal surface of the projecting lens. However, since the light-emitting diodes are borne by a flat printed circuit board, the entrance faces of the light guides are arranged in the same plane. Thus, the light guides that are located a distance away from the optical axis of the projecting lens have a larger length than that of the light guides located in proximity to said optical axis.

However, such a primary optical element is not easy to manufacture because of the variable lengths of the light guides.

Furthermore, the length of the light guides located at the ends of the primary optical element is such that the choice of the material used to produce the primary optical element is limited for example to silicone. It is in particular not possible to produce the light guides from polycarbonate or from PMMA.

BRIEF SUMMARY OF THE INVENTION

The invention proposes an optical module for a motor vehicle, said module having a longitudinal optical axis and including:

- a matrix array of elementary light sources each of which is able to emit a primary elementary beam from a common emission plane that is orthogonal to the optical axis;
- a projecting lens that is arranged longitudinally at a distance in front of the matrix array of elementary light sources and that is able to project the image of the elementary light sources, the projecting lens including an object focal surface having a curvature defect; characterized in that a field-correcting second optical element is interposed between the emission plane and the projecting lens.

The field-correcting optical element is designed so that the image of the curved focal surface of the projecting lens through the field-correcting optical element is an object focal plane that coincides with the emission plane of the matrix array of elementary light sources. Thus, all the light sources are clearly imaged by the projecting lens despite its field defect.

According to other features of the invention:

- the field-correcting optical element includes an entrance face for the light rays, which face is arranged longitudinally a distance away from the emission plane;
- the module includes a primary optical element including a plurality of light guides of longitudinal principal axes, each light guide including an entrance face through which light rays emitted by associated primary light sources enter and an exit front end face through which light rays exit, which face is arranged in the emission plane, each exit face forming a secondary elementary light source of said matrix array of elementary light sources;

the primary light sources are arranged in a plane parallel to the emission plane, all the light guides having an identical longitudinal length;

all the light guides are produced in a primary optical element produced in a common block including a common exit front face for the light rays;

the entrance face of the field-correcting optical element is arranged longitudinally a distance away from the exit face of the primary optical element;

the field-correcting optical element is formed by at least one field-correcting lens;

the field-correcting optical element is formed by a single field-correcting lens;

the entrance face of the field-correcting lens is concave at its center in proximity to the optical axis;

the entrance face of the field-correcting lens is convex on its periphery radially a distance away from the optical axis;

the field-correcting lens includes a convex exit face.

The invention also relates to a motor-vehicle lighting device of the front headlamp type which comprises the optical module produced according to any one of the preceding claims.

According to another feature of the invention, the lighting device furthermore comprises a low-beam module.

BRIEF DESCRIPTION OF THE FIGURES

Other features and advantages of the invention will become apparent on reading the following detailed description, which will be better understood with reference to the appended drawings, in which.

DETAILED DESCRIPTION OF THE FIGURES

In the rest of the description, the following orientations will be adopted nonlimitingly:

longitudinal "L" oriented from back to front along the optical axis of the projecting lens of the optical module;

transverse "T" oriented from left to right; and vertical "V" oriented from bottom to top.

The vertical orientation "V" is used by way of geometric reference and has no relation to the direction of gravity.

In the rest of the description, elements having an identical structure and/or analogous functions will be referenced with the same references.

Figure 1:
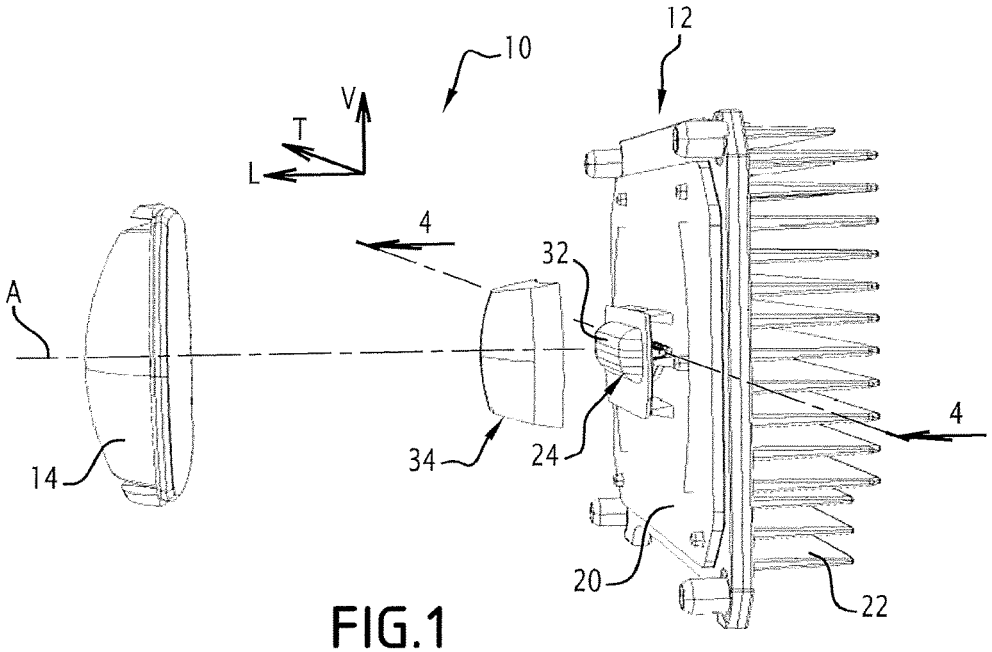
FIG. 1 is a perspective view that shows a signaling or lighting device including an optical module produced according to the teachings of the invention.

FIG. 1 shows an optical module 10 with which a signaling or lighting device for a motor vehicle is intended to be equipped. The optical module 10 is intended to emit a final light beam forward longitudinally. It is here a question of an adaptive light beam that is composed of a plurality of elementary beams that overlap. Such an optical module 10 is in particular able to provide an adaptive high-beam function also referred to as an adaptive driving beam or ADB, or it is also able to provide directional lighting, also referred to as dynamic bending light or DBL.

The lighting device includes at least the optical module 10. The optical module 10 mainly includes light-emitting means 12 and a projecting lens 14 that is arranged longitudinally in front and a distance away from the emitting means 12. The projecting lens 14 has a longitudinal optical axis "A".

As a variant (not shown) of the invention, the lighting device furthermore comprises a second low-beam module that is able to emit a single dipped low beam.

The light-emitting means 12 here include a matrix array 16 of primary light-emitting light sources 18. It is here a question of light-emitting diodes 18. The matrix array 16 is equipped with two transverse rows of seventeen light-emitting diodes 18. The optical axis "A" passes substantially through the middle of the matrix array 16 in the transverse direction.

The matrix array 16 lies in a plane orthogonal to the longitudinal direction "L". More particularly, the light-emitting diodes 18 are here borne by the front face of a printed circuit board 20.

These light-emitting diodes 18 are liable to emit heat during their operation. A heat sink 22 including cooling fins is therefore adhesively bonded to the back of the printed circuit board 20 in order to remove the heat.

The light-emitting diodes 18 emit very open light rays in a light cone. Furthermore, each light-emitting diode 18 has an emission area the dimensions of which must be adapted to be able to be effectively used by the optical module 10. To this end, the optical module includes a first primary optical element 24 is arranged longitudinally in front of the matrix array 16 of light-emitting diodes 18 in order to modify the distribution of the emitted light rays.

Figure 2:
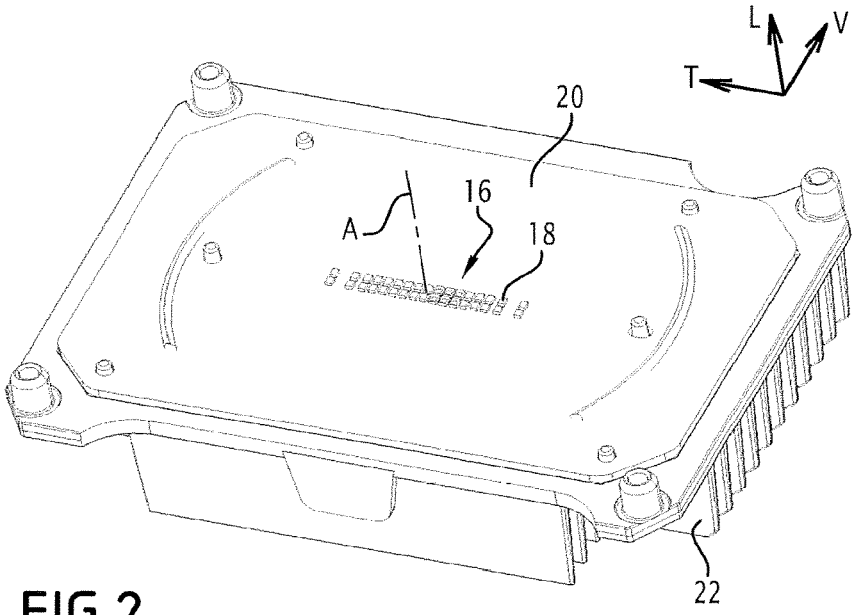
FIG. 2 is a perspective view that shows a printed circuit board of the device of FIG. 1 including a matrix array of light-emitting diodes.

As FIG. 2 shows, the primary optical element 24 here includes a first back section 24A that is formed from a plurality of light guides 26. Each light guide 26 extends along a longitudinal principal axis from an entrance face 28 to an exit front end face 30 for the light rays, which in particular may be seen in FIG. 4. Each light guide 26 is designed to guide the light rays entering via the entrance face 28 to the exit face 30. In the context of the invention, each exit face 30 forms a secondary elementary light source that will be referred to as a "secondary elementary light source 30" below.

The back section 24A includes a matrix array including at least as many light guides 26 as the matrix array 16 includes light-emitting diodes 18. Each light guide 26 is associated with one light-emitting diode 18. Thus, the back section 24A includes two rows of seventeen light guides 26.

The entrance faces 28 of the light guides 26 are arranged in a common plane that is parallel to the plane of the printed circuit board 20. When the primary optical element 24 is arranged in the optical module 10, each entrance face 28 is thus positioned longitudinally facing and in proximity to an associated light-emitting diode 18, as is illustrated in FIG. 4, so that most of the light rays emitted by each light-emitting diode 18 enter into the associated light guide 26.

Figure 3:
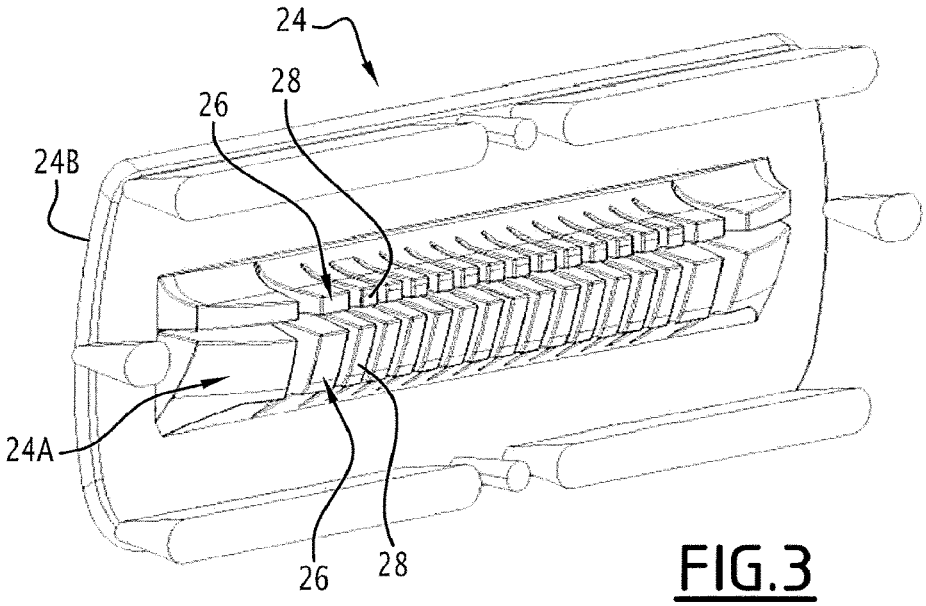
FIG. 3 is a perspective view that shows the back of a primary optical element of the device of FIG. 1 including a plurality of light guides.

As may be seen in FIG. 3, each light guide 26 is liable to have a cross-section suitable for producing an exiting primary elementary light beam of the shape desired for the function of the optical module 10 with which the signaling or lighting device is equipped.

Figure 4:
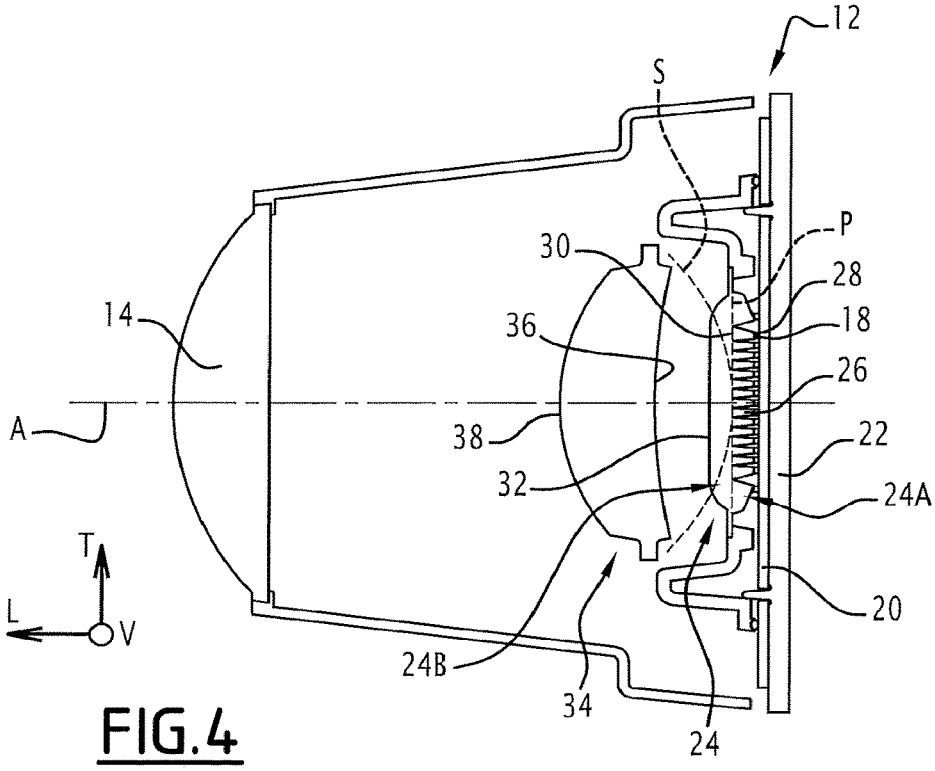
FIG. 4 is a cross-sectional view of the horizontal section plane 4-4 of FIG. 1, in which the curved object focal surface of the projecting lens and the plane in which the exit faces of the light guides of the primary optical element have been shown by dashed lines.

The exit faces of the light guides 26, i.e. the faces forming the secondary elementary light sources 30, are arranged in a common emission plane "P" that is parallel to the plane of the printed circuit board 20, as indicated in FIG. 4. In this way, the light guides 26 all have an identical length.

The exit faces of the light guides 26 thus form a matrix array of secondary elementary light sources 30, here two rows of seventeen secondary sources, each of which is able to emit a primary elementary beam in a principal longitudinal direction of projection from the common emission plane "P" that is orthogonal to the longitudinal direction "L". The exit faces, i.e. the faces forming the secondary elementary light sources, are arranged in immediate proximity to one another, for example at a distance of 0.1 mm from one another.

The primary optical element 24 also includes a front section 24B for shaping the primary elementary light beams emitted by the secondary elementary light sources 30. This front section 24B for example allows the elementary light beams to be spread vertically and/or horizontally.

The front section 24B includes a common exit front end face 32 for the light rays of the primary optical element.

This front section 24B is here integrally formed with the light guides 26 so that the primary optical element 24 is produced in one block.

The primary optical element 24 is for example made of silicone, polycarbonate, polymethyl methacrylate (PMMA) or any other material suitable for producing light guides 26.

The projecting lens 14 is arranged longitudinally at a distance in front of the emission plane "P". The projecting lens 14 is able to project an image of the secondary elementary light sources 30 to infinity in order to form the final light beam. In projection on a transverse vertical screen (not shown) located at great distance, for example at 25 m, each secondary elementary light source 30 allows a zone of the screen to be illuminated. The zones overlap slightly so as to illuminate uniformly. Each diode 18 is individually controlled so as to make it possible to selectively illuminate each of the zones of the screen.

The projecting lens 14 is here produced in a single block.

As is known, the projecting lens 14 includes an object focal surface "S" that on the whole lies orthogonally to the optical axis "A", which it intersects at the object focal point.

In order for the obtained final beam to have the luminous characteristics desired for its use, it is necessary for the secondary elementary light sources 30 to be imaged in a substantially clear way. To this end, each secondary elementary light source 30 is to be located on the object focal surface of the projecting lens 14.

Theoretically, the projecting lens 14 is supposed to have a planar object focal surface that is perfectly orthogonal to the optical axis "A". However, in fact, it is known that the projecting lens 14 has an object focal surface having a concave spherical curvature defect. Such a defect is called Petzval field curvature.

To allow the projecting lens to be correctly focused on the secondary elementary light sources 30, a field-correcting second optical element 34 is interposed between the emission plane "P" and the projecting lens 14. This field-correcting optical element 34 is specifically designed to correct the Petzval field curvature of the projecting lens 14.

The field-correcting optical element 34 is formed so that, seen from the primary optical element 24, the image of the curved focal surface "S" of the projecting lens 14 through the field-correcting optical element 34 lies in an object focal plane that coincides with the emission plane "P" of the matrix array of secondary elementary light sources 30. The projecting lens 14 will have been positioned beforehand so that the object focal surface "S" is tangent to the emission plane "P", the effect of the field-correcting optical element 34 being to flatten the object focal surface "S" toward the emission plane "P".

The field-correcting optical element 34 is formed by at least one field flattener lens. In the example shown in the figures, the field-correcting optical element 34 includes a single field flattener lens, which will therefore be referenced 34 below.

As a variant (not shown) of the invention, the field-correcting optical element includes a plurality of field flattener lenses arranged in series along the optical axis.

The field-correcting optical element 34 includes an entrance back face 36 for light rays, which face is arranged longitudinally a distance away from the emission plane "P". The entrance face 36 of the field-correcting optical element 34 is arranged longitudinally a distance away from the exit face 32 of the primary optical element 24. As may be seen in FIG. 4, the entrance face 36 of the field flattener lens is concave in its center in proximity to the optical axis "A".

As a variant (not shown) of the invention, the entrance face 36 of the field flattener lens is convex on its periphery radially a distance away from the optical axis.

The field-correcting optical element 34 includes an exit front face 38 for the light rays. This exit face 38 is arranged longitudinally facing and a distance away from the projecting lens 14. The exit face 38 here has a convex form.

By virtue of the arrangement of the field-correcting optical element 34 between the primary optical element 24 and the projecting lens 14, it is possible to produce short light guides 26 having an identical length. The primary optical element 24 is thus easier to manufacture.

It is in particular possible to use materials that do not allow long light guides to be obtained by molding. It is thus possible to make the primary optical element 24 according to the invention from polycarbonate whereas primary optical elements according to the prior art comprising very long light guides could only be made of silicone.

It will of course be understood that, a fortiori, the primary optical element 24 produced according to the teachings of the invention may be made of silicone.

The invention claimed is:

1. An optical module for a motor vehicle, said module having a longitudinal optical axis and comprising:

a matrix array including two rows of elementary light sources each of which is configured to emit a primary elementary beam from a common emission plane that is orthogonal to the optical axis;

a projecting lens that is arranged longitudinally at a distance in front of the matrix array of elementary light sources and that is configured to project the image of the elementary light sources, the projecting lens including an object focal surface having a curvature defect; and a field-correcting optical element interposed between the emission plane and the projecting lens, the field-correcting optical element compensating for the curvature defect in the object focal surface of the projecting lens, wherein the optical module includes a primary optical element including a plurality of light guides of longitudinal principal axes, each light guide of the plurality of light guides corresponding to a different one of the elementary light sources of the matrix array, each light guide including an entrance face through which light rays emitted by an associated primary light source of the matrix array enter and an exit front end face through which light rays exit, which face is arranged in the emission plane, each exit face forming a secondary elementary light source of said matrix array of elementary light sources, all of the light guides are produced in a primary optical element produced in a common block including a common exit front face for the light rays, and the entrance face of the field-correcting optical element is arranged longitudinally a distance away from the exit face of the primary optical element.

2. The module according to claim 1, wherein the field-correcting optical element includes an entrance face for light rays, which face is arranged longitudinally a distance away from the emission plane.

3. The module according to claim 1, wherein the primary light sources are arranged in a plane parallel to the emission plane, all the light guides having an identical longitudinal length.

4. The module according to claim 1, wherein the field-correcting optical element is formed by at least one field-correcting lens.

5. The module according to claim 4, wherein the field-correcting optical element is formed by a single field-correcting lens.

6. The module according to claim 5, wherein the entrance face of the field-correcting lens is concave at its center in proximity to the optical axis.

7. The module according to claim 6, wherein the entrance face of the field-correcting lens is convex on its periphery radially a distance away from the optical axis.

8. The module according to claim 5, wherein the field-correcting lens includes a convex exit face.

9. A motor-vehicle lighting device of a front headlamp type which comprises the module according to claim 1.

10. The lighting device according to claim 9, further comprising a low-beam module.

11. The module according to claim 2, wherein the field-correcting optical element is formed by at least one field-correcting lens.

12. The module according to claim 6, wherein the field-correcting lens includes a convex exit face.

13. A motor-vehicle lighting device of a front headlamp type which comprises the module according to claim 2.

14. The module according to claim 1, wherein the field-correcting optical element is a lens.

15. The module according to claim 1, wherein the field-correction element includes a plurality of field-flattener lenses.

16. The module according to claim 1, wherein the elementary light sources are light emitting diodes.

17. The module according to claim 1, further comprising a printed circuit board on which the elementary light sources are disposed.

18. The module according to claim 17, further comprising a heat sink attached to a side of the printed circuit board that is opposite a side on which the elementary light sources are disposed.

19. The module according to claim 18, wherein the heat sink includes a plurality of fins to remove heat generated by the elementary light sources.

20. The module according to claim 1, wherein the plurality of light guides are arranged in two rows corresponding to the two rows of light sources in the matrix array, and light guides of one of the two rows differ in shape from light guides of the other of the two rows.

* * * * *